US005678329A

United States Patent [19]

Griffin et al.

[11] Patent Number: 5,678,329

[45] Date of Patent: Oct. 21, 1997

[54] ATHLETIC SHOE WITH MIDSOLE SIDE SUPPORT

[75] Inventors: Thomas J. Griffin, Highland Park; Susan B. Ryder, Wilmette, both of Ill.

[73] Assignee: Wilson Sporting Goods Co., Chicago, Ill.

[21] Appl. No.: 627,024

[22] Filed: Apr. 3, 1996

[51] Int. Cl.[6] ..... A43C 11/00; A43B 5/00

[52] U.S. Cl. ..... 36/50.1; 36/114; 36/30 R

[58] Field of Search ..... 36/145, 50.1, 170, 36/114, 31, 69, 68, 91, 88, 93, 25 R, 30 R

[56] References Cited

U.S. PATENT DOCUMENTS

| | | | |
|---|---|---|---|
| 838,751 | 12/1906 | Roberts | 36/50.1 X |
| 1,712,481 | 5/1929 | Ayers | 36/170 |
| 2,147,197 | 2/1939 | Glidden | 36/3 A X |
| 4,258,480 | 3/1981 | Famolare, Jr. | 36/91 |
| 4,322,895 | 4/1982 | Hockerson | 36/129 |
| 4,542,598 | 9/1985 | Misevich et al. | 36/114 |
| 4,758,098 | 7/1988 | Boggia | 36/114 |
| 4,769,927 | 9/1988 | Liggett et al. | 36/50.1 X |
| 4,811,500 | 3/1989 | Maccano | 36/50.1 X |
| 4,858,340 | 8/1989 | Pasternak | 36/88 |
| 4,881,329 | 11/1989 | Crowley | 36/38 |
| 5,005,299 | 4/1991 | Whatley | 36/25 R |
| 5,243,772 | 9/1993 | Francis et al. | 36/114 |
| 5,377,430 | 1/1995 | Hatfield et al. | 36/50.1 X |
| 5,440,826 | 8/1995 | Whatley | 36/25 R |
| 5,465,509 | 11/1995 | Fuerst et al. | 36/91 X |
| 5,497,564 | 3/1996 | Allen et al. | 36/50.1 X |

FOREIGN PATENT DOCUMENTS

| | | | |
|---|---|---|---|
| 160318 | 3/1921 | United Kingdom | 36/170 |

*Primary Examiner*—B. Dayoan

[57] ABSTRACT

An athletic shoe includes an outsole, a midsole, and an upper. Portions of the midsole extend upwardly along the sides of the upper. The upper and the upwardly extending portions of the outsole are provided with lace openings through which a shoe lace extends.

9 Claims, 1 Drawing Sheet

ATHLETIC SHOE WITH MIDSOLE SIDE SUPPORT

BACKGROUND AND SUMMARY OF THE INVENTION

This invention relates to athletic shoes, and, more particularly, to an athletic shoe in which the sole provides lateral support to the sides of the upper.

Athletic shoes are intended for use in strenuous activities such as tennis, basketball, jogging, etc. The shoe should provide proper support for the foot as the athlete stops suddenly, turns, jumps, and the like.

The invention provides an athletic shoe in which the sides of the upper are stabilized and reinforced by upwardly extending portions of the midsole. The upwardly extending portions of the midsole are provided with lace openings, and a shoe lace extends through the lace openings in the upwardly extending portions of the midsole and lace openings in the upper. When the shoe lace is tightened and tied, the upwardly extending portions of the midsole are tightened against the sides of the foot and provide lateral support.

DESCRIPTION OF THE DRAWINGS

The invention will be explained in conjunction with an illustrative embodiment, in which.

DESCRIPTION OF SPECIFIC EMBODIMENT

Figure 1:
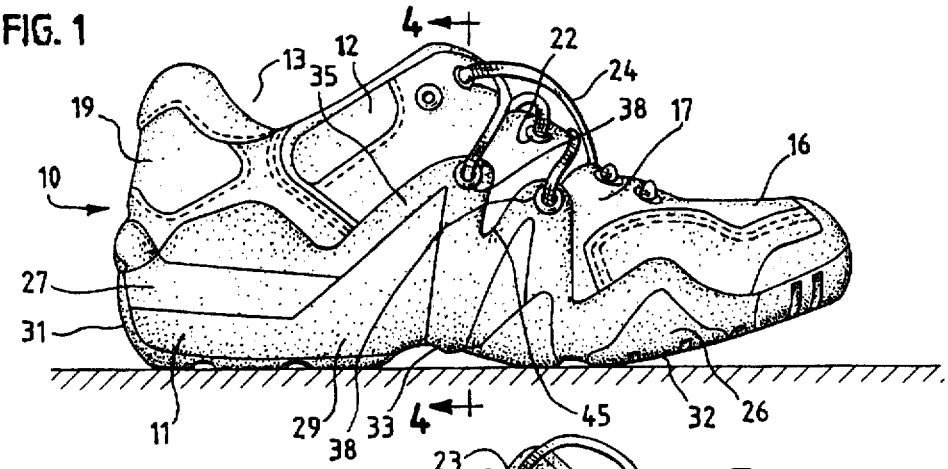
FIG. 1 is a right side elevational view of a shoe formed in accordance with the invention.
Figure 2:
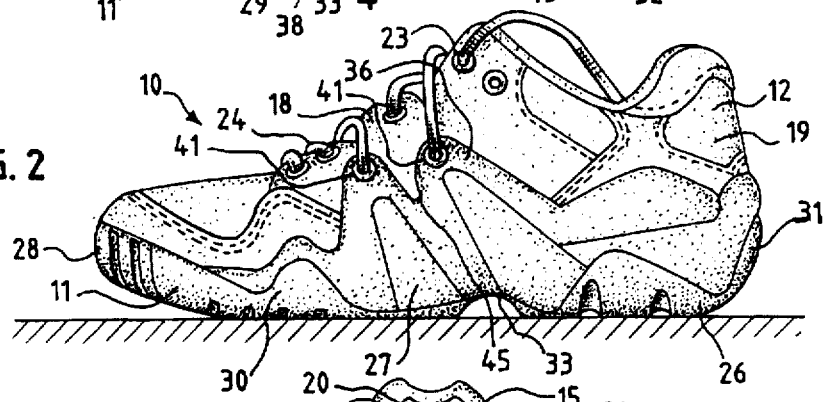
FIG. 2 is a left side elevational view of the shoe.
Figure 3:
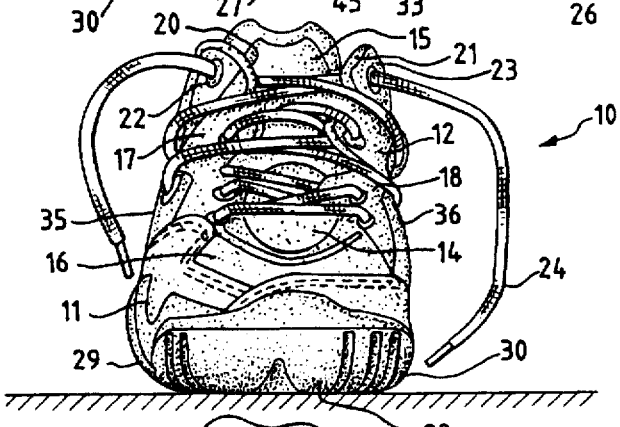
FIG. 3 is a front elevational view of the shoe.

An athletic shoe 10 includes a sole 11 and an upper 12. The upper is provided with a foot opening 13 which includes a tongue opening 14, and a tongue 15 covers the tongue opening.

The upper includes a toe portion 16, a pair of side portions, 17 and 18, and a heel portion 19. The side portions 17 and 18 include side edges 20 and 21, respectively, which define the tongue opening. A plurality of lace openings or eyelets 22 and 23 are provided in the side portions 17 and 18 for a shoe lace 24. The upper can be formed from conventional materials, for example, leather, canvas, synthetic material, etc.

The sole 11 includes an outsole 26 and a midsole 27 which are secured together. The sole includes a toe portion 28, side portions 29 and 30, and a heel portion 31.

The outsole 26 includes a bottom surface 32 which is provided with the usual traction-providing ribs and grooves. The bottom surface may include an upwardly curved instep portion 33. The outsole is formed from material which provides suitable friction and durability, such as rubber.

The sides of the midsole 27 include right and left side upwardly extending portions 35 and 36 which extend over the upper toward the lace openings 22 and 23. The upwardly extending portions 35 and 36 of the midsole are preferably secured to the side portions of the upper, for example, by adhesive.

Figure 4:
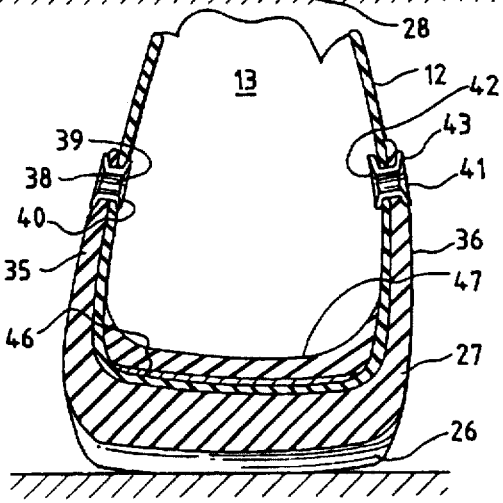
FIG. 4 is a sectional view taken along the line 4—4 of FIG. 1.

The right side upwardly extending portion 35 is provided with a pair of lace openings 38 which are aligned with lace openings 39 (FIG. 4) in the upper. An eyelet 40 is secured within the openings 38 and 39. Similarly, the left side upwardly extending portion 36 is provided with a pair of lace openings 41 which are aligned with lace openings 42 in the upper. An eyelet 43 is secured within the openings.

The upwardly extending portions of the midsole extend toward the lace openings 22 and 23 in the upper, and the lace openings 38 and 41 are positioned adjacent, although somewhat below, the lace openings 22 and 23 which are closest to the lace openings 38 and 41. The lace openings 38 and 41 are preferably located more than ½, and more preferably at least ⅔, of the distance between the bottom surface of the outsole and the adjacent lace opening 22 and 23.

The shoe lace 24 crisscrosses between the first two lace openings 22 and 23 in the upper at the bottom of the tongue opening. Thereafter, the shoe lace alternates between the lace openings (38, 41) in the upwardly extending midsole portions 35 and 36 and the lace openings (22, 23) in the upper. When the shoe lace is tightened and tied, the upwardly extending midsole portions are pulled against the sides of the foot on both sides of the instep. The foot is thereby supported laterally by the midsole, which reinforces the sides of the upper and stabilizes the foot. The material of the midsole may be thicker and/or stronger than the material of the upper, and the upwardly extending midsole portions restrain the foot from sliding laterally outwardly beyond the sides of the outsole.

The midsole may be formed from EVA, polyurethane, or similar material. In the embodiment illustrated, each upwardly extending midsole portion is provided with a recess 45 between the lace openings in the midsole. However, the recess can be omitted if desired.

The particular shoe illustrated also includes an inner layer of cushion material 46 (FIG. 4) and an insole 47 between the bottom of the foot and the bottom of the upper.

Alternatively, the shoe could omit the midsole. In that event side portions of the outsole would extend upwardly along the sides of the upper. Also, the sole could extend along only one side of the upper if reinforcement on only one side is desired. If desired, the lace openings in the upwardly extending portions of the sole need not be aligned with lace openings in the upper. Instead, the top portions of the upwardly extending portions of the sole could be unattached to the upper so that the laces could be inserted through the lace openings.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. An athletic shoe comprising an outsole having a heel portion, a pair of side portions, and a toe portion, an integral midsole formed of midsole material having a heel portion and a toe portion adapted to underlie a foot of a wearer and integral side portions, an upper attached to the midsole, the upper including inside and outside surfaces, a heel portion, a pair of side portions, and a toe portion and having a foot opening and a plurality of lace openings, and a shoe lace extending through the lace openings, at least one of the side portions of the midsole having an integral upwardly extending portion which overlies a portion of the outside surface of one of the side portions of the upper and which is provided with a lace opening, the shoe lace extending through the lace opening of the upwardly extending portion of the midsole, whereby the upwardly extending portion of the midsole can be tightened against a foot of a wearer to provide lateral support.

2. The shoe of claim 1 in which the lace opening in the upwardly extending portion of the midsole is aligned with a lace opening in the upper.

3. The shoe of claim 1 in which said upwardly extending portion of the midsole is provided with a pair of lace openings through which the shoe lace extends.

4. The shoe of claim 1 in which the midsole material is selected from the group consisting of EVA and polyurethane.

5. An athletic shoe comprising an outsole having a heel portion, a pair of side portions, and a toe portion, an integral midsole formed of midsole material having a heel portion and a toe portion adapted to underlie a foot of a wearer and integral side portions, an upper attached to the midsole, the upper including inside and outside surfaces, a heel portion, a pair of side portions, and a toe portion and having a foot opening and a plurality of lace openings, and a shoe lace extending through the lace openings, each of the side portions of the midsole having an integral upwardly extending portion which overlies a portion of the outside surface of one of the side portions of the upper and which is provided with a lace opening, the shoe lace extending through the lace openings of the upwardly extending portions of the midsole, whereby the upwardly extending portions of the midsole can be tightened against a foot of a wearer to provide lateral support.

6. The shoe of claim 5 in which each of the lace openings in the upwardly extending portions of the midsole is aligned with a lace opening in the upper.

7. The shoe of claim 5 in which each of upwardly extending portions of the midsole extend for more than half of the distance between the outsole and the lace openings in the upper.

8. The shoe of claim 5 in which each of the upwardly extending portions of the midsole is provided with a pair of lace openings through which the shoe lace extends.

9. The shoe of claim 5 in which the midsole material is selected from the group consisting of EVA and polyurethane.

* * * * *